United States Patent [19]

Chessin et al.

[11] Patent Number: 4,731,167

[45] Date of Patent: Mar. 15, 1988

[54] METHOD OF ELECTROPLATING AN ADHERENT CHROMIUM ELECTRODEPOSIT ON A CHROMIUM SUBSTRATE

[75] Inventors: Hyman Chessin, Brick; Warren H. McMullen, East Brunswick, both of N.J.

[73] Assignee: M&T Chemicals Inc., Woodbridge, N.J.

[21] Appl. No.: 928,949

[22] Filed: Nov. 12, 1986

[51] Int. Cl.[4] ..... C25D 5/12

[52] U.S. Cl. ..... 204/41; 204/51

[58] Field of Search ..... 204/32.1, 51, 41, DIG. 1-2

[56] References Cited

U.S. PATENT DOCUMENTS 1,942,356 1/1934 Fink et al. ..... 204/1

FOREIGN PATENT DOCUMENTS 1486696 5/1967 France ..... 204/41

5528309 8/1978 Japan ..... 204/41

OTHER PUBLICATIONS

"Cr. Plating" Finshing Publs., Ltd., Teddington, Eng. 1980, pp. 147-148, Weiner & Walmsley.

*Primary Examiner*—R. L. Andrews

*Attorney, Agent, or Firm*—S. H. Parker; R. E. Bright

[57] ABSTRACT

What is described herein is an improved method of electroplating an adherent chromium deposit on a chromium substrate. The process is characterized by chemically oxidizing the chromium substrate before starting the electrodeposition of chromium thereon. A suitable chemical oxidizing agent is hydrogen ion, which can be furnished by a dilute acid solution. In this invention, the acid is characterized by being destroyed in the plating bath, if dragged therein. Suitable acids include oxalic and citric acids. The process is applicable to any chromium electroplating bath, including high energy efficient chromium baths, such as HEEF-40 baths, which are presently in commercial use.

11 Claims, No Drawings

METHOD OF ELECTROPLATING AN ADHERENT CHROMIUM ELECTRODEPOSIT ON A CHROMIUM SUBSTRATE

BACKGROUND OF THE INVENTION

1. Field of the Invention

This invention relates to electroplating of chromium, and, more particularly, it is concerned with an improved process of forming an adherent chromium electrodeposit on a chromium substrate.

2. Description of the Prior Art

Normally, electrodeposited chromium does not adhere well to a chromium underlayer, and for this reason electrolysis must not be interrupted during the plating process. If the article needs to be removed from the solution for any reason, the plating process must be restarted in a special way. Fink, in U.S. Pat. No. 1,942,356, describes the only known method of obtaining an adherent chromium electrodeposit on such a chromium substrate. The method disclosed by Fink comprises warming the chromium part to the bath temperature and then applying voltage slowly until the plating current is reached. Subsequently, Weiner and Walmsley included a mild anodic electrochemical etching step in the Fink process, as described in *Chromium Plating*, Finishing Publications Ltd., Teddington, England (1980) p. 147–8.

The Fink process works well for the conventional sulfate, or a mixed catalyst chromium electroplating bath, and for the 25% efficiency bath described by Chesin and Newby in U.S. Pat. No. 4,588,481.

Unfortunately, however, it is not satisfactory for the high energy efficiency (HEEF) baths, such as described by H. Chessin in U.S. Pat. No. 4,472,249, where the plating efficiency is 40% or higher.

Accordingly, an object of the present invention is to provide an improved process of electro-depositing adherent chromium onto a chromium substrate.

Another object herein is to provide such a process which can be used with the HEEF-40% efficiency chromium baths.

Still another object is to provide a method which can be applied after an interruption in the plating chromium process.

A particular object of this invention is to provide an activation treatment for chromium substrate in a solution which can be added to the chromium plating bath without deleterious effects.

SUMMARY OF INVENTION

What is described herein is a method of electroplating an adherent chromium deposit on a chromium substrate. The process is characterized by chemically oxidizing the chromium substrate before starting the electrodeposition of chromium thereon. A suitable chemical oxidizing agent is hydrogen ion, which can be furnished by a dilute acid solution. In this invention, the acid is characterized by being destroyed in the plating bath, if dragged therein. Suitable acids include oxalic and citric acids. The process is applicable to any chromium electroplating bath, including high energy efficient chromium baths, such as HEEF-40 baths, which are presently in commercial use.

DETAILED DESCRIPTION OF THE INVENTION

The present invention can be understood most clearly by comparison with the prior art method, as described below. Accordingly, in the prior art method of Weiner and Walmsley, the chromium substrate is treated after a electroplating process has been interrupted where less than the desired amount of chromium deposit has been formed. The process steps of the prior art, and what happens during each such process step, are summarized below in Table I.

TABLE I

| PRIOR ART | |
|---|---|
| Step | What Happens During Process Step |
| (1) Electrochemically etch chromium substrate in plating bath. | $Cr \rightarrow Cr^{+3}$ (no film formation) |
| (2) Plating is initiated at less than the Cr deposition voltage. | $2H^{+} \rightarrow H_2$; $Cr^{+6} \rightarrow Cr^{+3}$, (the $Cr^{+3}$ may form a film) |
| (3) Voltage is raised to allow full plating current. Continue chromium electroplating. | Adherent Cr is deposited from conventional, mixed catalyst and HEEF-25% Cr baths only. (does not work for HEEF-40% baths of U.S. Pat. No. 4,472,249) |

In the present process, as described in copending application Ser. No. 908,434, filed Sept. 17, 1986, and assigned to the same assignee as herein, the oxide film on the chromium substrate, if present, is removed, chemically or electrolytically, and the substrate is chemically oxidized by hydrogen ion, whereupon a film is formed which is substantially free of $Cr^{+6}$. There is no requirement for the slow application of voltage, although it may be used. The present method is usable with all known hexavalent chrome baths, including the commercial HEEF-40% baths which are based on U.S. Pat. No. 4,472,249.

In this invention, the hydrogen ion in the activation step of chemically oxidizing the chromium substrate is furnished by a dilute acid which can be destroyed in the plating bath. Suitably, such acids are hydroxy or oxy-substituted carboxylates which are capable of being destroyed in the bath by being oxidized by chromic acid to form a gaseous product, for example, $CO_2$. The $Cr^{+3}$ reduction product then is reoxidized in the bath to $Cr^{+6}$ at the anode. Accordingly, the use of such oxidizable acids avoids the necessity of water rinsing the activated chromium substrate to prevent drag-in of deleterious chemicals into the plating bath.

Suitable acids thus include those acids which provide the necessary hydrogen ion for chemical oxidation of chromium and are themselves oxidized by chromic acid, preferably to form a gaseous product. Representative acids for use herein include oxidizable carboxylic acids, e.g. hydroxy, amino and oxycarboxylic acids, as for example, oxalic, citric, tartaric, glutaric and formic acid. The present invention will be illustrated by reference to Table II.

TABLE II

| PRESENT INVENTION | |
|---|---|
| Process Step | What Happens During Process Step |
| (1) Remove oxide film on chromium substrate and initiate chemical oxidation in defined | $2H^{+} \rightarrow H_2$<br>$Cr \rightarrow Cr^{+3}$<br>A gray/green/black film form on the Cr surface |

TABLE II-continued

| PRESENT INVENTION | |
|---|---|
| Process Step | What Happens During Process Step |
| acid, as evidenced by $H_2$ evolution (if necessary, briefly apply cathodic current to initiate $H_2$ evolution film on Cr substrate, e.g. 1 min. at 1 asi). Continue $H_2$ evolution without current for about 2–3 minutes. | |
| (2) Plating is commenced in any $Cr^{+6}$ bath. | Adherent Cr is deposited (applicable to HEEF-40% baths); Acid is oxidized by chromic acid to form a gaseous product, and $Cr^{+3}$, which is reoxided to $Cr^{+6}$ at the anode. |

The invention will be further illustrated by the accompanying examples.

EXAMPLE 1

A chromium substrate having an oxide thereon was placed in a solution of 15% by weight oxalic acid at room temperature and made electrically cathodic, whereupon the oxide film was removed and evolution of $H_2$ commenced. The current was then turned off and $H_2$ evolution was allowed to continue for 3 min. A gray/black film formed on the chromium substrate. The substrate then was plated with chromium from a commercial M&T Chemicals, Inc. HEEF-40% chromium bath, based on U.S. Pat. No. 4,472,249, at 5 asi for 30 min. Adhesion of the chromium deposit was excellent.

EXAMPLE 2

The process of Example 1 was repeated using solutions of citric acid or tartaric acid in place of oxalic acid at tempratures ranging from room temperature to 60° C.; and excellent adhesion of the chromium deposit on the treated chromium substrate was obtained in each instance.

EXAMPLE 3

The process of Example 1 was repeated using a chromium substrate which had been plated with chromium several months previously and had a thick oxide coating thereon. This substrate first was made anodic in a 100 g/l NaOH solution for 3 minutes at 3 asi and water rinsed before following the steps of Example 1. Excellent adhesion of the chromium deposit was obtained.

Similar results were attained when 10% $H_2SO_4$ or 250 g/l $CrO_3$ solution were substituted for the 100 g/l NaOH electrolyte in the first step above. In fact, the acid bath of Examples 1 and 2 can be used for this step.

EXAMPLE 4

The processes of Examples 1–3 were repeated using (a) a conventional chromium plating bath, and (b) a HEEF-25% bath (U.S. Pat. No. 4,588,481), with similar excellent adhesion of chromium on the chromium substrate.

While the invention has been described with respect to certain embodiments thereof, it will be understood that changes and modifications may be made which are within the skill of the art. Accordingly, it is intended to be bound only by the following claims, in which:

What is claimed is:

1. A method of electroplating an adherent chromium deposit on a chromium substrate which comprises the step of chemically oxidizing the chromium substrate by hydrogen ion before electrodepositing chromium from a chromium electroplating bath, said hydrogen ion being furnished by an acid which can be oxidized by chromic acid in said bath to form a gaseous product.

2. A method according to claim 1 wherein said acid is a hydroxy or oxy-substituted carboxylate.

3. A method according to claim 4 wherein said acid is citric, tartaric, oxalic, glutaric or formic acids.

4. A method according to claim 1 wherein cathodic current is briefly applied to the chromium substrate before said chemical oxidizing step.

5. A method according to claim 1 wherein said chemical oxidizing is evidenced by hydrogen evolution and formation of a gray, green-black film on the surface of the chromium substrate.

6. A method according to claim 1 wherein said electrodeposition of chromium is carried out from a conventional sulfate, mixed catalyst, HEEF-25%, or a HEEF-40%-type chromium electroplating bath.

7. A method according to claim 1 wherein said chemical oxidizing step is carried out after an interruption in the chromium plating process and before restarting chromium plating.

8. A method according to claim 1 wherein any oxide film which may be present on the chromium substrate is removed chemically or electrolytically before chemically oxidizing the chromium substrate.

9. A method according to claim 10 wherein said oxide film is removed anodically in an electrolyte.

10. A method according to claim 1 wherein said electrodeposition of chromium is carried out on the chemically oxidized chromium substrate without rinsing the activated substrate.

11. A method according to claim 10 wherein said acid is oxidized by chromic acid in the chromium plating bath to form a gaseous product and $Cr^{+3}$, which $Cr^{+3}$ is reoxidized to $Cr^{+6}$ at the anode, thus avoiding drag-in of chemicals into said plating bath.

* * * * *